US009534491B2

(12) United States Patent
Miller et al.

(10) Patent No.: US 9,534,491 B2
(45) Date of Patent: Jan. 3, 2017

(54) DETECTION OF POSITION OF A PLUNGER IN A WELL

(71) Applicant: Rosemount Inc., Chanhassen, MN (US)

(72) Inventors: John Philip Miller, Ardmore, OK (US); David Lyle Wehrs, Eden Prairie, MN (US)

(73) Assignee: Rosemount Inc., Chanhassen, MN (US)

( * ) Notice: Subject to any disclaimer, the term of this patent is extended or adjusted under 35 U.S.C. 154(b) by 492 days.

(21) Appl. No.: 14/039,625

(22) Filed: Sep. 27, 2013

(65) Prior Publication Data

US 2015/0090445 A1 Apr. 2, 2015

(51) Int. Cl.

| | |
|---|---|
| ***E21B 47/09*** | (2012.01) |
| ***E21B 47/06*** | (2012.01) |
| ***E21B 43/12*** | (2006.01) |
| ***E21B 47/00*** | (2012.01) |

(52) U.S. Cl.

CPC ..... *E21B 47/09* (2013.01); *E21B 43/121* (2013.01); *E21B 47/0007* (2013.01); *E21B 47/06* (2013.01)

(58) Field of Classification Search

CPC ..... E21B 47/09; E21B 47/06

See application file for complete search history.

(56) References Cited

U.S. PATENT DOCUMENTS

| | | | |
|---|---|---|---|
| 3,863,714 A | 2/1975 | Watson, Jr. | |
| 4,961,441 A | 10/1990 | Salter | |
| 4,989,671 A | 2/1991 | Lamp | |
| 5,314,016 A | 5/1994 | Dunham | |
| 5,526,883 A | 6/1996 | Breaux | |
| 5,636,693 A | 6/1997 | Elmer | |
| 5,753,812 A | 5/1998 | Aron et al. | |
| 5,785,123 A | 7/1998 | Lea, Jr. | |
| 5,826,659 A | 10/1998 | Hershberger | |
| 5,878,817 A | 3/1999 | Stastka | |
| 5,957,200 A | 9/1999 | Majek et al. | |
| 5,984,013 A | 11/1999 | Giacomino et al. | |
| 5,987,385 A * | 11/1999 | Varsamis | E21B 47/0002 702/6 |
| 6,196,324 B1 | 3/2001 | Giacomino et al. | |
| 6,241,014 B1 | 6/2001 | Majek et al. | |
| 6,464,011 B2 | 10/2002 | Tubel | |

(Continued)

FOREIGN PATENT DOCUMENTS

| | | |
|---|---|---|
| CN | 1165956 | 11/1997 |
| CN | 1445434 | 10/2003 |

(Continued)

OTHER PUBLICATIONS

Office Action from Australian Patent Application No. 2013323937, dated Sep. 11, 2015.

(Continued)

*Primary Examiner* — Giovanna C Wright

(74) *Attorney, Agent, or Firm* — Westman, Champlin & Koehler, P.A.

(57) ABSTRACT

A system for detecting when a plunger reaches a bottom of a well includes a pressure sensor configured to measure a pressure of the well and provide a measured pressure output. Derivative calculation circuitry calculates a derivative of the measured pressure output. Detection circuitry detects when the plunger reaches the bottom of the well based upon the calculated derivative.

29 Claims, 14 Drawing Sheets

(56) References Cited

U.S. PATENT DOCUMENTS

| | | | | |
|---|---|---|---|---|
| 6,595,287 | B2 | 7/2003 | Fisher | |
| 6,634,426 | B2 * | 10/2003 | McCoy | E21B 43/121 137/487 |
| 6,705,404 | B2 | 3/2004 | Bosley | |
| 6,719,060 | B1 | 4/2004 | Wells | |
| 6,830,108 | B2 | 12/2004 | Rogers, Jr. | |
| 6,883,606 | B2 | 4/2005 | Evans et al. | |
| 6,907,926 | B2 | 6/2005 | Bosley | |
| 6,966,366 | B2 | 11/2005 | Rogers, Jr. | |
| 7,004,258 | B2 | 2/2006 | Farris | |
| 7,040,401 | B1 | 5/2006 | McCannon | |
| 7,099,780 | B2 | 8/2006 | Faur et al. | |
| 7,219,725 | B2 | 5/2007 | Chisholm | |
| 7,401,624 | B2 | 7/2008 | Heer | |
| 7,597,143 | B2 | 10/2009 | Giacomino | |
| 7,620,522 | B2 | 11/2009 | Bredau et al. | |
| 7,690,425 | B2 | 4/2010 | Giacomino | |
| 7,819,189 | B1 * | 10/2010 | Cosby | E21B 43/121 166/250.01 |
| 7,963,326 | B2 | 6/2011 | Giacomino | |
| 8,176,998 | B2 | 5/2012 | Brostom | |
| 2005/0178543 | A1 | 8/2005 | Giacomino | |
| 2008/0110617 | A1 | 5/2008 | Giacomino | |
| 2009/0200020 | A1 | 8/2009 | Hearn | |
| 2009/0258618 | A1 * | 10/2009 | Moroni | G01D 11/245 455/128 |
| 2012/0193091 | A1 | 8/2012 | Bender | |
| 2014/0048158 | A1 * | 2/2014 | Baca | E21B 34/08 137/511 |
| 2014/0102698 | A1 * | 4/2014 | Bergman | E21B 43/121 166/255.1 |

FOREIGN PATENT DOCUMENTS

| | | |
|---|---|---|
| CN | 1726366 | 1/2006 |
| CN | 101061320 | 10/2007 |
| CN | 101469609 | 7/2009 |
| CN | 102057130 | 5/2011 |
| EP | 1 319 800 | 6/2003 |
| WO | WO 02/29197 A2 | 4/2002 |

OTHER PUBLICATIONS

Office Action from Chinese Patent Application No. 201210509974.3, dated Oct. 16, 2015.

Office Action from U.S. Appl. No. 13/630,783, dated Sep. 8, 2015.

Notification of Transmittal of the International Search Report and Written Opinion from International Application No. PCT/US2014/050509, dated Apr. 8, 2015.

Communication pursuant to Rule 161(1) and 162 EPC from European Patent Application No. 13770606.5, dated Jul. 17, 2015, 2 pages.

International Search Report and Written Opinion dated Sep. 11, 2014 for corresponding International Application No. PCT/US2013/060540, filed Sep. 19, 2013.

Dieter Joseph Becker et al., "Plunger Lift Optimization by Monitoring and Analyzing Wellbore Acoustic Signals and Tubing and Casing Pressures", Oct. 1, 2006, pp. 11-13, XP055139529.

Office Action from U.S. Appl. No. 13/630,783, dated Feb. 16, 2016.

Communication from European Patent Application No. 14755501.5, dated May 19, 2016.

Office Action from Chinese Patent Application No. 201410336401.4, dated Oct. 9, 2016.

* cited by examiner

DETECTION OF POSITION OF A PLUNGER IN A WELL

BACKGROUND

The present invention relates to plungers of the type which are used to remove liquid from a natural gas well or the like. More specifically, the invention relates to detecting position of the plunger as it moves along a length of the well.

Deep wells are used to extract gas and liquids from within the ground. For example, such wells are used to extract natural gas from underground gas pockets. The well comprises a long tube which is placed in a hole which has been drilled into the ground. When the well reaches a pocket of natural gas, the gas can be extracted to the surface.

As a natural gas well ages, liquid such as water tends to collect at the bottom of the well. This water slows, and eventually prevents, the natural gas from flowing to the surface. One technique which has been used to extend the lives of well is a plunger-based lift system which is used to remove the liquid from the bottom of the well. Position of the plunger within the well is controlled by opening and closing a valve at the top of the well. When the valve is closed, flow of gas out of the well is stopped and the plunger falls through the water to the bottom of the well. When the plunger reaches the bottom of the well, the valve can be opened whereby pressure from within the well pushes the plunger to the surface. As the plunger rises, it lifts any liquid which is above it up to the surface thereby removing most of the liquid from the well.

In order to efficiently operate the plunger, it is desirable to identify when the plunger reaches the bottom of the well. Various techniques have been used to determine when the plunger reaches the bottom of the well, for example, U.S. Pat. No. 7,963,326, issued Jun. 21, 2011, entitled "Method and Apparatus for Utilizing Pressure Signature in Conjunction with Fall Time as Indicator in Oil and Gas Wells" to Giacomino describes one technique.

SUMMARY

A system for detecting when a plunger reaches a bottom of a well includes a pressure sensor configured to measure a pressure of the well and provide a measured pressure output. Derivative calculation circuitry calculates a derivative of the measured pressure output. Detection circuitry detects when the plunger reaches the bottom of the well based upon the calculated derivative.

DETAILED DESCRIPTION OF ILLUSTRATIVE EMBODIMENTS

The present invention provides a system for identifying when a plunger reaches a bottom of a well, such as a natural gas well. More specifically, a method and apparatus are provided in which pressure of the well is measured. The measured pressure is analyzed and is used to identify when the plunger reaches the well bottom. Rather than solely using pressure anomalies to identify plunger locations, the present invention uses pressure sensor signal derivative information. In specific examples, a first derivative and/or a second derivative of the measured pressure is monitored. Changes in the first and/or second derivative are used to identify when the plunger reaches the well bottom.

When a natural gas well first begins its operation, gas typically flows freely from below ground to the surface, aided by a high pressure usually present in the reservoir. However, during the life of the well, water begins to flow into the bottom of a gas well. The resulting back-pressure of the water column, coupled with a decrease in the reservoir pressure causes the flow of natural gas to slow, and eventually stop completely.

One solution to this problem is to shut the well in (closing a valve at the well head) allowing the pressure in the reservoir to build up again. When the pressure builds up sufficiently, the valve is opened again, and the built-up pressure pushes the water to the top. However, the drawback of this approach is that a large amount of the water falls back to the bottom of the well, and in the end, the well doesn't gain much additional gas production.

Figure 1:
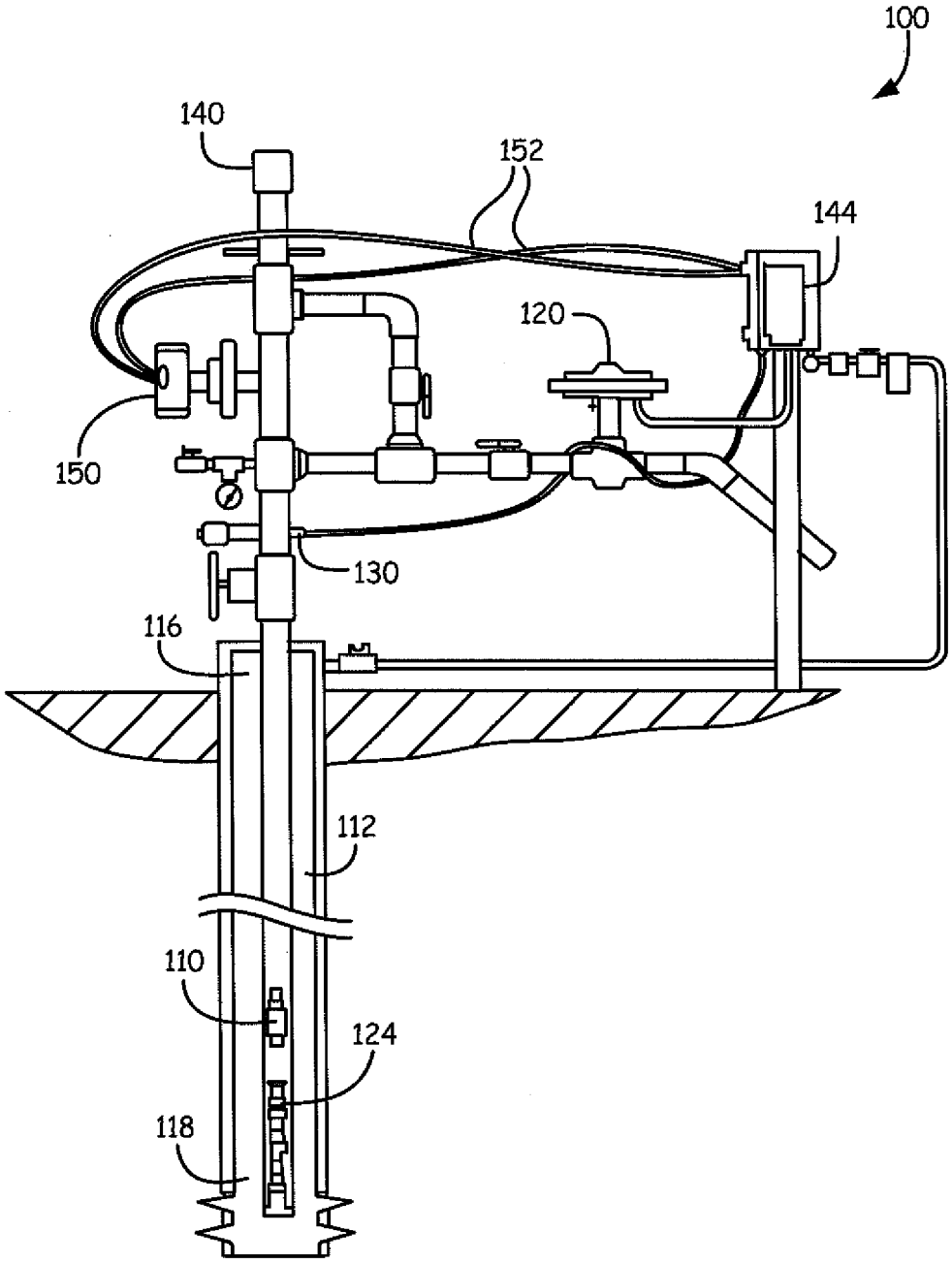
FIG. 1 is a simplified view of a well employing the system for identifying a location of a plunger in accordance with the present invention.

A better solution, and the one that is most commonly used in gas wells, is to use a plunger to lift the water out of the well. FIG. 1 illustrates a typical gas well 100 with a plunger lift system. The plunger 110 is a device approximately the same diameter as the center tubing 112 of the well 100, which freely moves up and down the well. A motor valve 120 is used to open and close the well, causing the plunger 110 to travel to the top 116 or bottom 118 of the well, as described below. At the bottom 118 of the well is a bumper spring 124, which prevents damage to the plunger 110 when it hits bottom 118. At the well head is the catcher and arrival sensor 130 which catches the plunger 110 when it comes to the top 116 of the well, and generates an electronic signal indicating the arrival of the plunger 110. Above the catcher is the lubricator 140, which applies an oil, or other lubricant to the plunger 110, ensuring that it will move through the tubing freely. The electronic controller 144 operates the well by receiving available measurement signals (e.g. tubing pressure and plunger arrival), and by sending commands to the motor valve 120 to open and close at the appropriate time.

Plunger assemblies used for lifting the well's fluid production to the surface operate as very long stroking pumps. The plunger 110 is designed to serve as a solid interface between the fluid column and the lifting gas. When the plunger 110 is travelling, there is a pressure differential across the plunger 110 which will inhibit any fluid fallback. Therefore, the amount delivered to the surface should be virtually the same as the original load. The plunger 110 travels from bottom 118 to top 116, acting as a wiper, removing liquids in the tubing string. There are many types of plungers which are available.

The plunger 110 itself may take various forms. Some plungers include spring loaded expanding blades which seal against the tubing walls of the well to create pressure differential for the upwards stroke. Other types of plungers include plungers with labyrinth rings to provide sealing, plungers with an internal bypass which allows the plunger to fall more rapidly, etc.

Because a gas producer may operate thousands of wells, the instrumentation and control on any given well is typically very minimal. In some instances, the only measurements that may be made on the well are made with two pressure transmitters, one measuring the tubing pressure (the center tube through which the plunger falls, and through which gas normally flows) and the other measuring the casing pressure (also called the annulus—an outer void containing the tubing). Motor valve 120 opens and closes to control the plunger 110 falling to the bottom 118 of the well 100, or coming to the top 116, and the electric controller 144, often a Programmable Logic Controller (PLC) or Remote Operator Console (ROC). The controller 144 receives the available measurement signals, and opens and closes the motor valve 120 at the appropriate time, in order to keep the well operating optimally. In some configurations, there may also be a plunger arrival sensor (which senses when the plunger reaches the well head), a temperature measurement sensor or a flow rate sensor.

One of the important aspects of gas control with plunger lift is that the well must be shut in for an appropriate length of time. Specifically, the well must be shut in long enough for the plunger to reach the bottom. If the plunger does not get all the way to the bottom, then when the motor valve is opened not all of the water will be removed, and the well will not return to optimal production. If this occurs, the time that it took for the plunger to fall and return (which could be 30 minutes or longer) will have been wasted. Even more critical is that if the motor valve is opened before the plunger hits any water, then without the water to slow down the plunger, the speed of the plunger coming up (caused by the large pressure within the well) may be so great that it will damage the plunger or lubricator/catcher, or even blow the catcher completely off the well head.

Because of the danger of bringing the plunger back up too early, most well control strategies will have a built-in "safety factor". They will shut the well in long enough for the plunger to reach the bottom, plus some additional time, just to ensure that the plunger does reach the bottom. The disadvantage here is that time the plunger is sitting on the bottom is time that the gas well is not producing. The longer the plunger has to sit on the bottom, the longer it will be before the gas well can return to full production.

Various techniques are employed to detect when the plunger reaches the bottom of the well. For example, pressure and acoustic signals can be monitored, however, these signals are often relatively small and difficult to identify due to the amount of background noise, the extended length of the well, and loss of signal as they flow through the liquid and gas in the well. Although a pressure transmitter is typically present on most wells, simply monitoring pressure and detecting pressure anomalies may lead to errors in determining plunger position. Further, an acoustic based device requires additional equipment to be specified, purchased, installed, configured and maintained. As discussed below in more detail, in one embodiment a pressure transmitter 150 is coupled to a pressure in the well 100 and used to determine when the plunger 110 reaches the bottom 118 of the well 100 based upon a derivative of a measured pressure. This information can be communicated to controller 144 and used to control operation of the well 100. For example, this information can be communicated to controller 144 using any appropriate technique such as, for example, a process control loop 152. The process control loop 152 can operate in accordance with standard communication techniques used in well operation including, for example, both wired and wireless communication techniques. The particular pressure measured by transmitter 150 is typically the pressure in the center column of the well, however, other pressure may also be monitored including pressures within various layers of the well casing.

Figure 2:
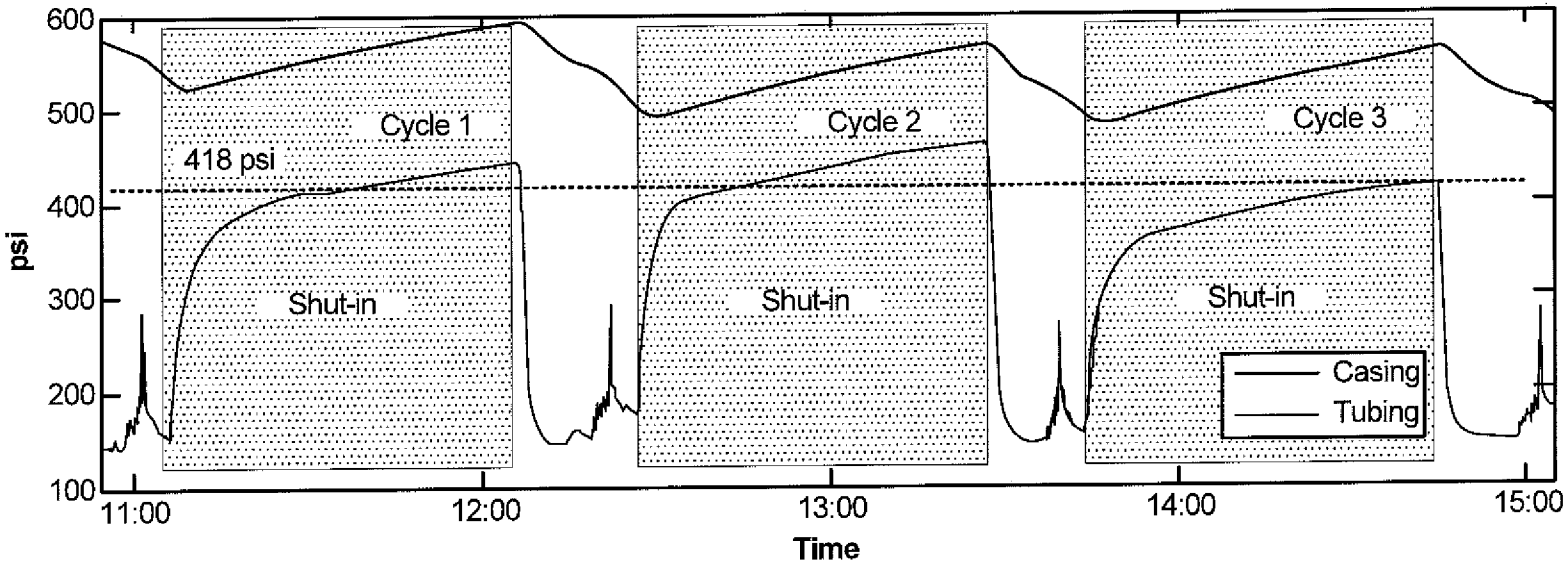
FIG. 2 is a graph of pressure versus time for an example well.

As discussed below, measurement of well pressure can be used to determine when the plunger in a well has reached the bottom of the well. FIG. 2 shows the well tubing pressure versus time from a first example well. A total of three plunger cycles are shown. The shaded boxes highlight the time of the well shut-in for each cycle, starting with when the motor valve is closed, and the plunger begins its descent, and ending with when the motor valve is opened again, and the plunger begins ascending to the surface. The dashed line shows the minimum tubing build-up pressure (418 psi). In this example, the well engineer has determined that after the shut-in, the tubing pressure needs to build up to at least 418 psi, so that there is enough back-pressure to bring the plunger back up to the top.

As illustrated in FIG. 2, this particular well also has a minimum shut-in time of 60 minutes. This is to ensure that the plunger reaches the bottom of the well before it is brought up. As previously described, the motor valve should not be opened too soon. The other danger in bringing up the plunger too soon is that if the plunger comes up completely dry, the pressure in the well could cause the plunger to build up enough speed to blow the catcher/lubricator assembly completely off the well head. Thus, there is typically a built in safety factor, requiring the well to be shut in for a minimum time. On this example well, the minimum shut-in time is 60 minutes.

Thus, on this well, the PLC or Well Controller has a shut-in logic that can be stated as:

IF Ptubing>418 psi AND Shut-in Time>60 min
THEN Open Motor Valve

Where Ptubing is the pressure in the well tubing.

Figure 3:
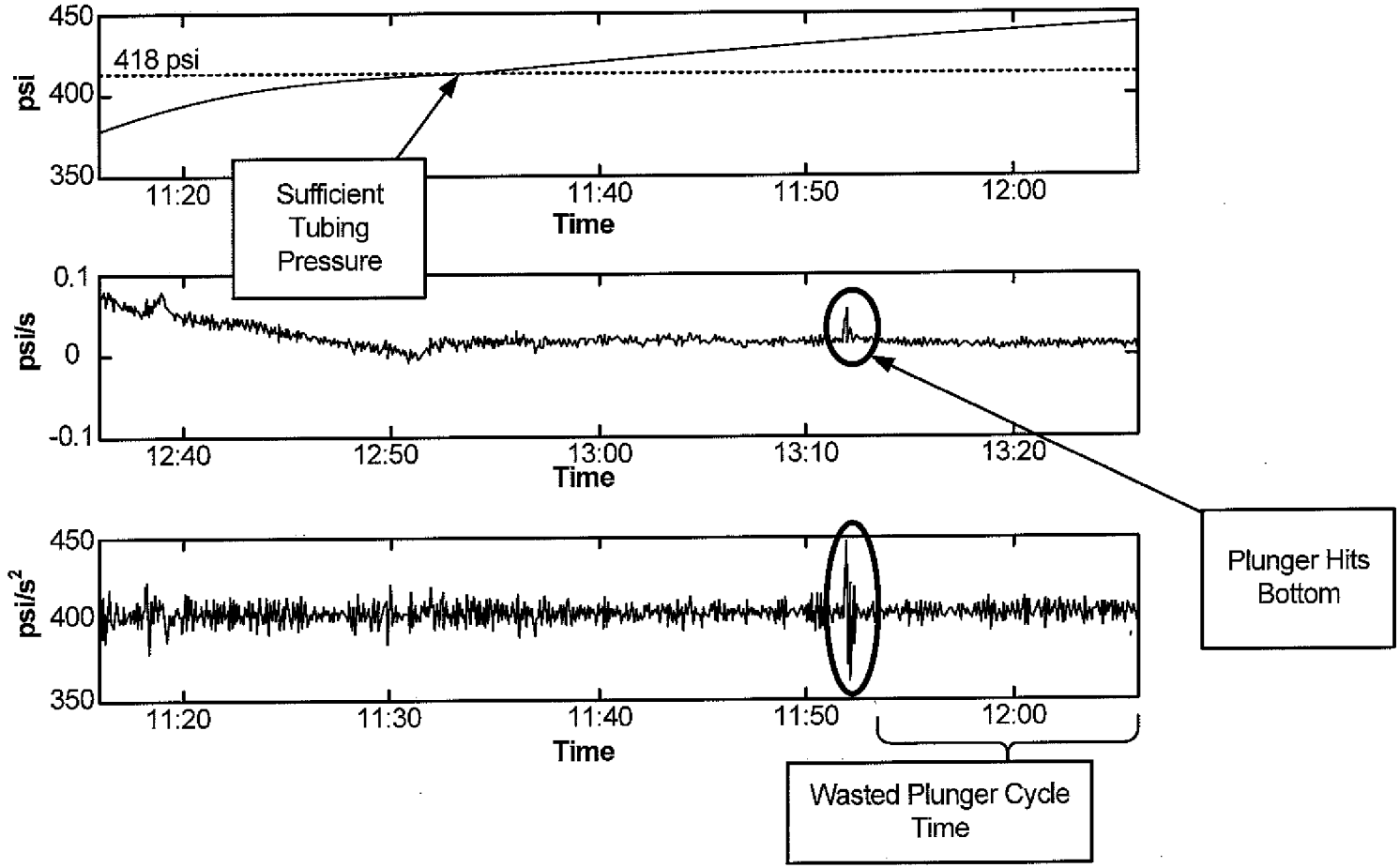
FIG. 3 shows graphs of pressure, along with its first and second derivatives, versus time taken from the graph of FIG. 2.

FIG. 3 shows an enlarged portion of the shut-in period for cycle 1 of FIG. 2. Note that the time period of this graph from 11:17 (about 11 minutes after the shut-in), until about 12:05 (just prior to the motor valve being opened). There are three trends visible on the plot. The top trend is the tubing pressure, as typically seen by the well controller. The middle and bottom graphs are, respectively, the first and second derivatives of the tubing pressure. The first derivative is an indication of the slope of the pressure signal. The second derivative provides an indication of the curvature of the pressure signal.

At 11:33, the tubing pressure has exceeded the minimum required tubing pressure of 418 psi. At 11:52, a distinct derivative event is visible in both the first and second derivatives of the tubing pressure. It can be deduced that this event corresponds to when the plunger reached the bottom of the well. Similar events appear at about the same time in the first and second derivatives of Cycle 2 (FIG. 4) and Cycle 3 (FIG. 5). This means that the plunger took 46 minutes to fall to the bottom, and has an average fall speed of 206 feet per minute.

As shown in FIG. 3, 14 minutes after the derivative event (at 12:06) the 60 minute shut-in time was reached and the motor valve was opened. Assuming that these events do correspond to the plunger reaching bottom, these 14 minutes are wasted cycle time. Bringing the plunger up 14 minutes sooner would allow the well to return to production that much more quickly.

Figure 4:
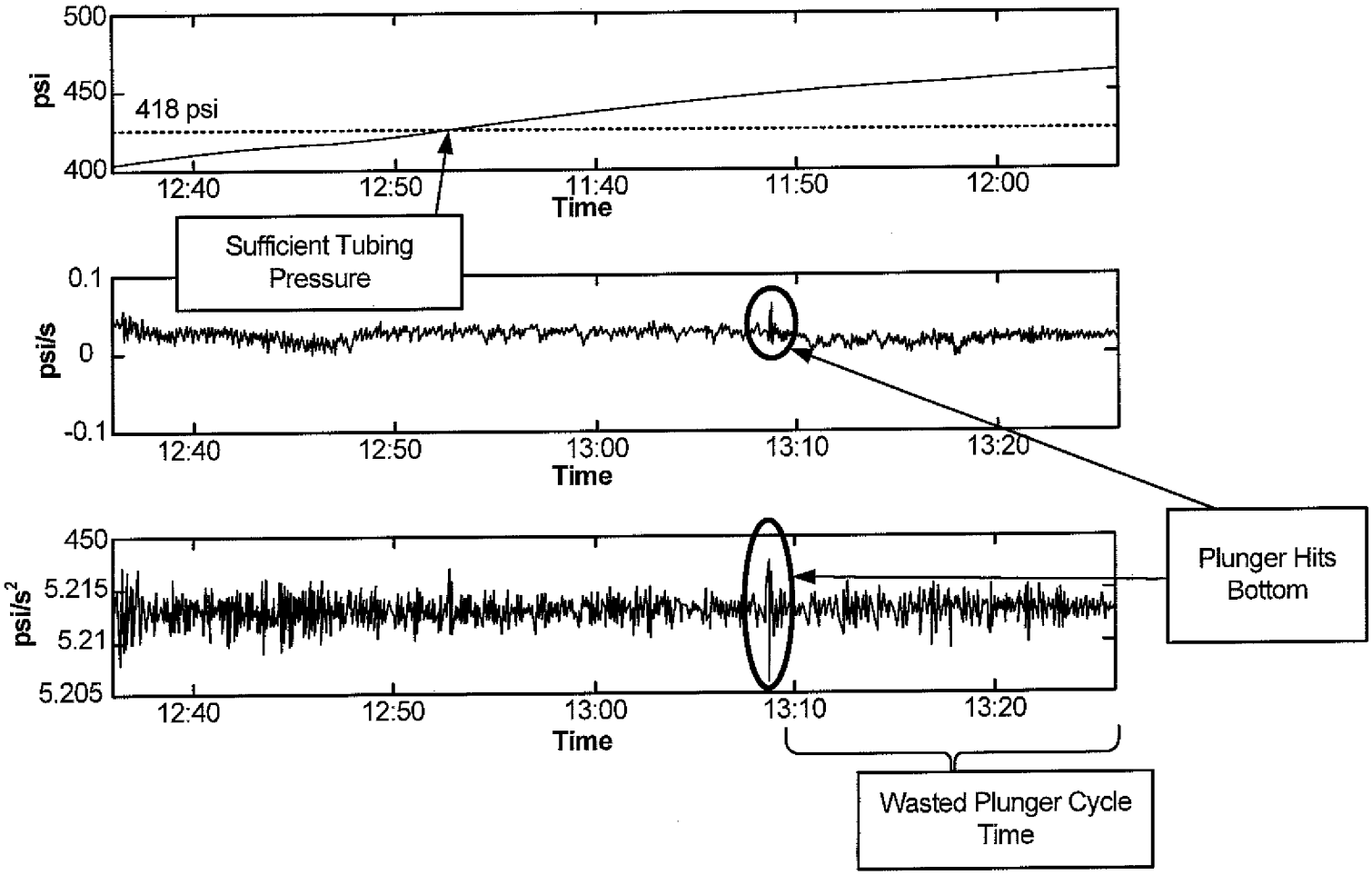
FIGS. 4 and 5 are more detailed views of pressure, its first derivative and its second derivative versus time from the graph of FIG. 2.
Figure 5:
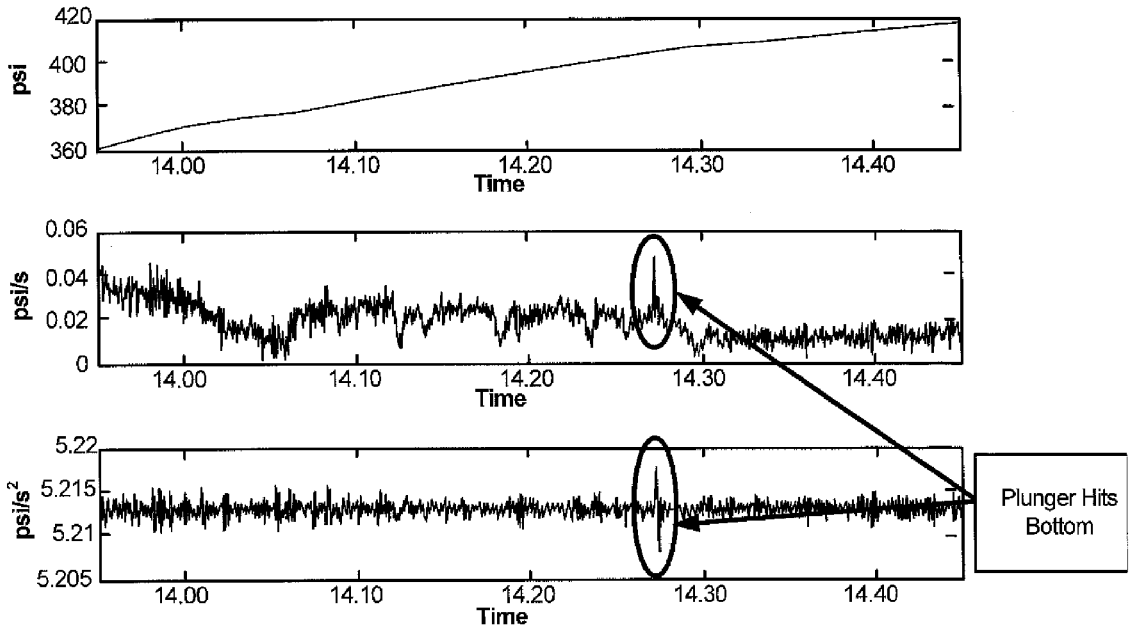

FIGS. 4 and 5 show the same graphs for Cycle 2 and Cycle 3 from the same well. The derivative events are seen respectively 42 minutes and 45 minutes after the well shut-in.

Figure 6:
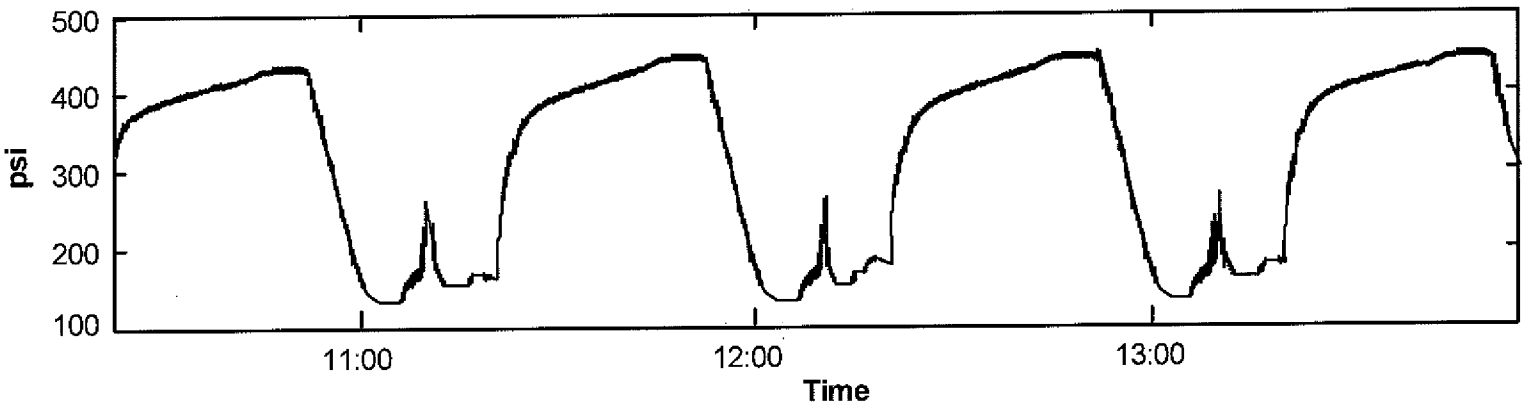
FIG. 6 is a graph of pressure versus time showing a number of cycles in another example well.
Figure 7:
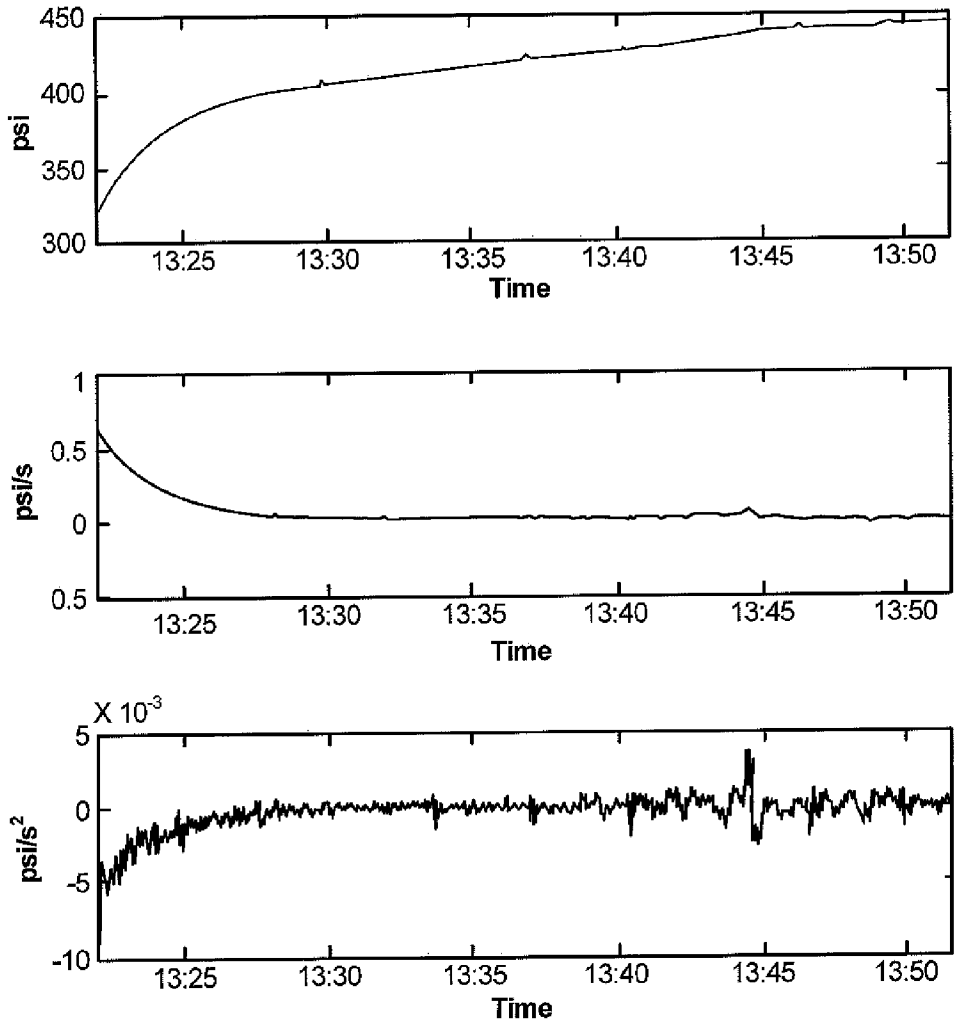
FIGS. 7, 8, 9 and 10 are graphs of pressure, its first, derivative and its second derivative versus time taken from the graph of FIG. 6.

Different wells may show different patterns of derivative events. FIG. 6 shows a graph of pressure versus time using tubing data that was taken from a second well. Data was collected for a total of 4 plunger cycles. FIG. 7 shows pressure versus time along with the first and second derivative plots for only one of the plunger cycles (Cycle 4). In this case, the event is most easily identified by a review of the second derivative calculation plot. The data shows a similar event for the other plunger cycles (1, 2, and 3), always at approximately the same time after shut-in. This derivative event also corresponds to the plunger hitting the bottom of the well.

As shown above, the Rate of Change (first and second derivatives) can be used to infer and identify plunger events. However, it would be difficult to perform well control based solely upon these pressure signal derivatives. This is because during periods in the plunger cycle other than the plunger fall period, the first and second derivatives of the tubing or casing pressure signal may be significantly higher than when the plunger hits water (or the well bottom). Therefore, it is necessary to provide some timing context to the plunger position determination so that these plunger events are only detected in a specific time window.

Figure 8:
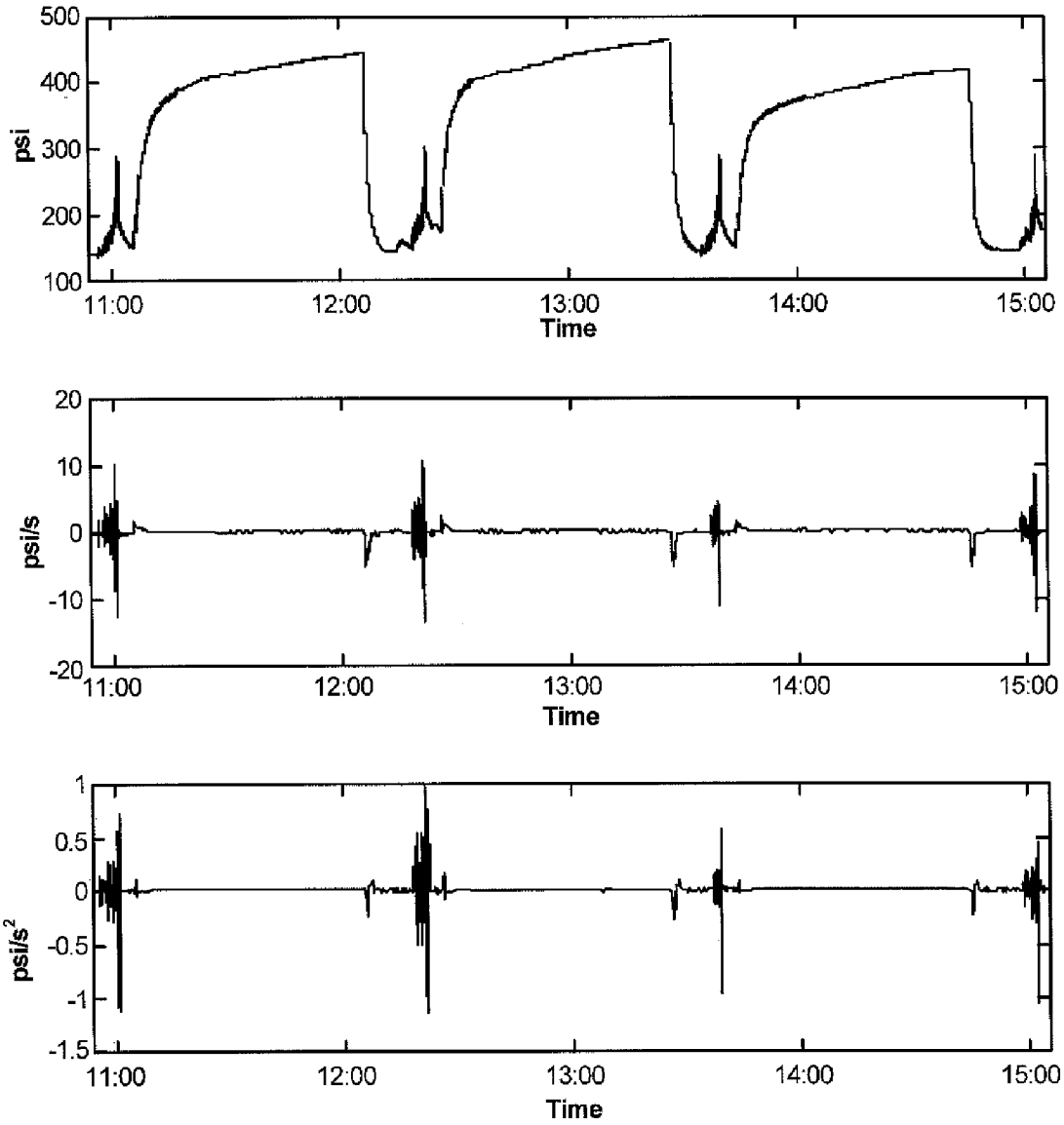

FIG. 8 illustrates graphs of tubing pressure and first and second derivatives versus time over multiple plunger cycles in another example well. The most abrupt changes in the tubing pressure occur just prior to the plunger returning to the well top (as the plunger is pushing slugs of water through the wells head). As a result of these abrupt tubing pressure changes, the first and second derivatives are erratic and go both positive and negative. Typically, in a well, it is possible to detect when the plunger reaches the top of the well using a number of different sensing technologies. These derivative events should be excluded in the determination of when the plunger reaches the bottom of the well.

Figure 9:
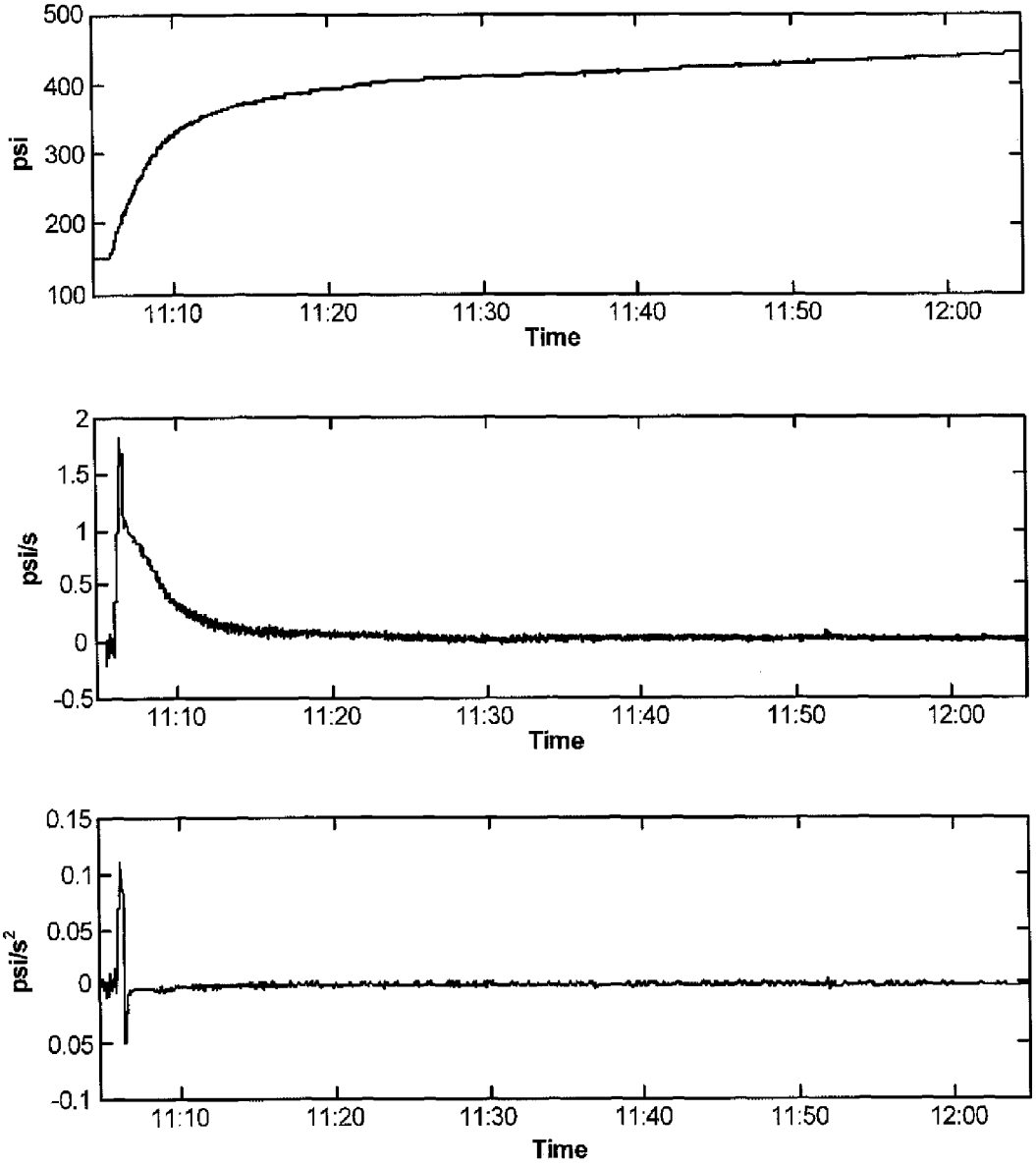

FIG. 9 shows the same plot of tubing pressure and first and second derivatives, for one of the plunger fall cycles of FIG. 8. FIG. 9 illustrates that immediately after the motor valve closes and the plunger initially begins to fall, there is a rapid increase in the tubing pressure, and as a result, a very large increase in the first and second derivatives. This is much larger than the changes in first and second derivatives that are seen when the plunger hits the well bottom. Again, the system should not detect a plunger event immediately after the motor valve closes.

Figure 10:
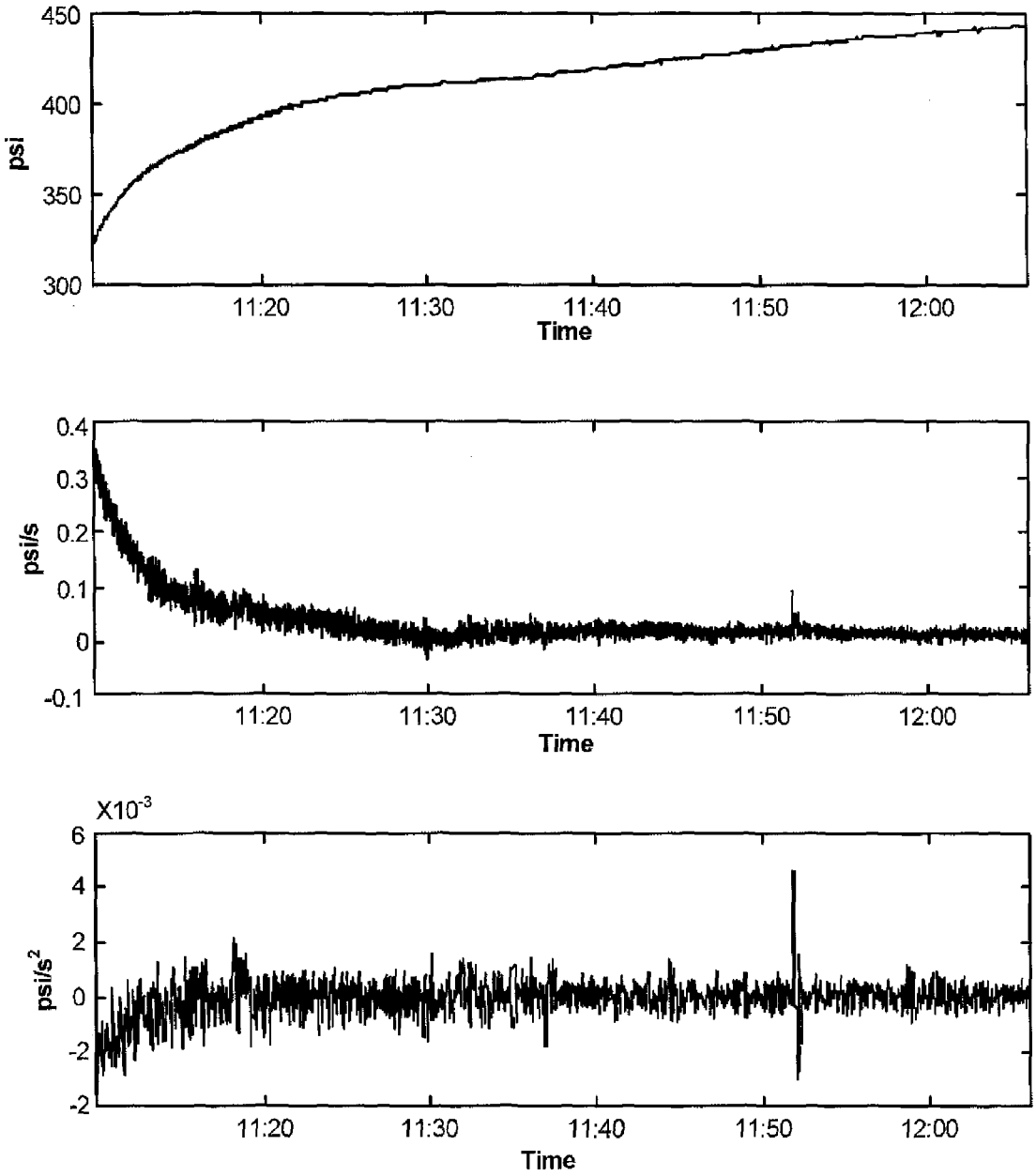

FIG. 10 shows a further enlarged portion of the same variables, beginning at about 10 minutes after the well shut-in. Here, the first and second derivatives very clearly show the detection of a plunger event, such as a plunger hitting the well bottom. This event provides additional value for optimizing the well because it can be used by the well controller to identify when the plunger reaches the well bottom. Therefore, a plunger event detection algorithm should include some type of timing and logic such that the plunger events are only detected at an appropriate time during the well cycle. For example, the pressure transmitter 150 shown in FIG. 1 can receive a command from a PLC after the motor valve is closed. A timer function can be utilized such that the pressure transmitter 150 only detects the derivative events after a certain number of minutes (e.g., 10 minutes) have passed after the start command.

Figure 11:
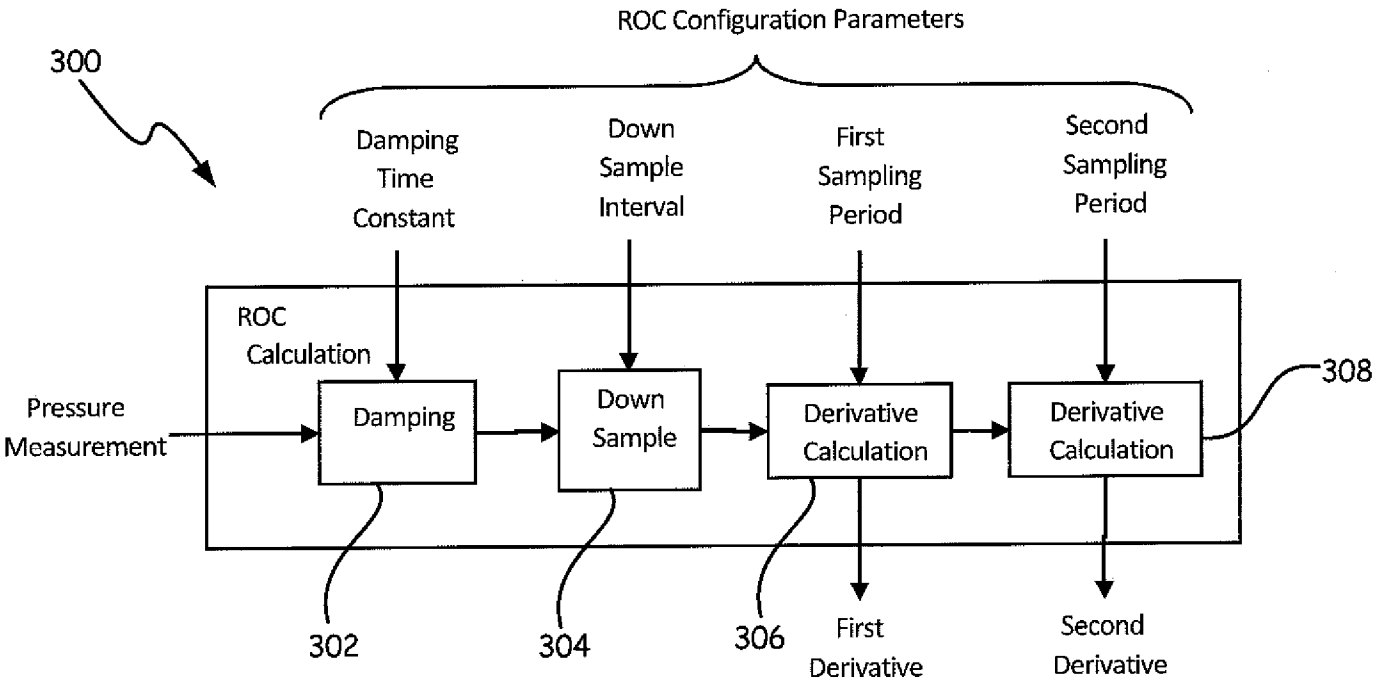
FIG. 11 is a simplified block diagram of rate of change calculation circuitry in accordance with one example embodiment.

FIG. 11 is a simple block diagram of rate of change calculation circuitry 300. Rate of change calculation circuitry receives a pressure measurement from a pressure sensor which is processed by damping circuitry 302. The damping circuitry 302 receives an adjustable damping time constant and can be used as a high frequency filter to reduce the amount of change in the pressure measurement signal and thereby reduce the amount of computation required to calculate the first and second derivatives. A down sample circuit 304 is also provided with an adjustable down sample interval. This down sampling reduces the amount of data in the pressure measurement signal thereby also reducing the amount of computation required to calculate the first and second derivatives. FIG. 11 also illustrates first and second derivative calculation circuitry 306 and 308, respectively. The first and second sampling periods can be adjusted as a rolling sampling time window over which the particular derivative is evaluated. These circuits operate using an adjustable first and second sampling periods and provide first and second derivative outputs, respectively. The various blocks illustrated in FIG. 11 may typically be implemented in a microprocessor operating in accordance with software instructions. However, it is also possible to implement these blocks as individual circuit components. The various rate of change parameters can be user configurable parameters or configured during manufacture. For example, these parameters can be adjusted for a particular well characteristic.

Figure 12:
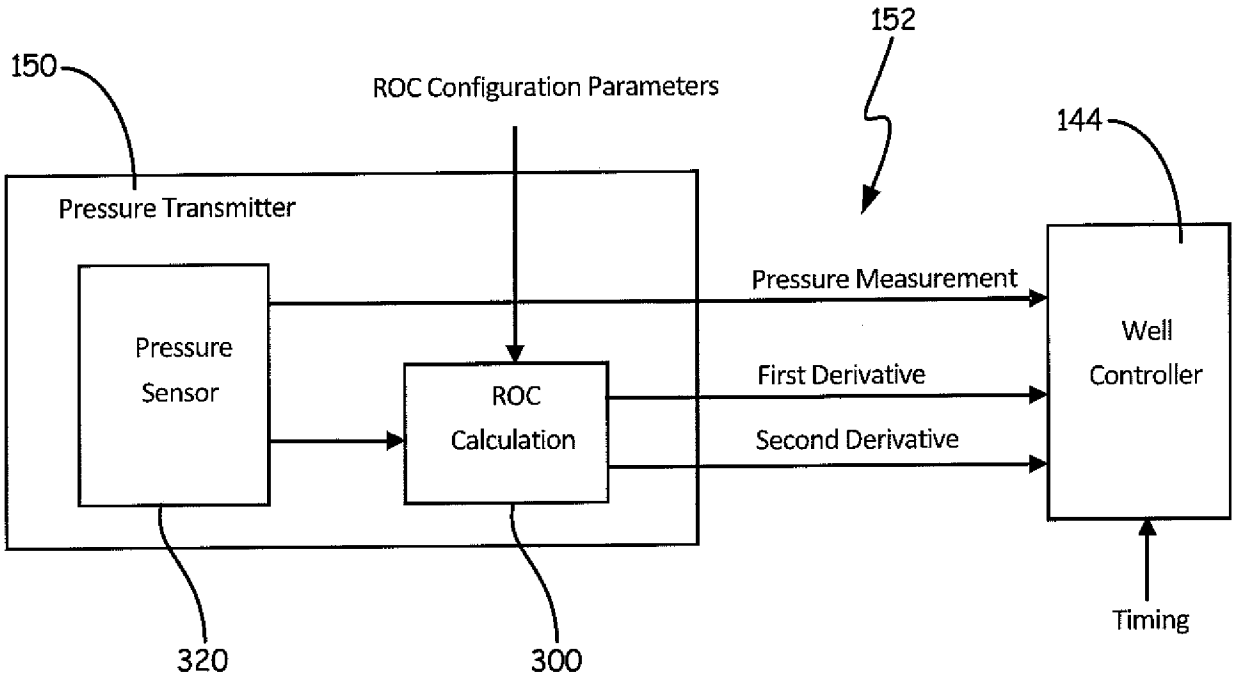
FIG. 12 is a simplified block diagram of a pressure transmitter and well controller system used to determine when a plunger has reached a bottom of a well.

FIG. 12 is a simplified diagram illustrating pressure transmitter 150 coupled to the well controller 144 over connection 152. Pressure transmitter 150 includes a pressure sensor 320 which provides pressure measurement information to rate of change calculation circuitry 300 as well as well controller 144. The first and second derivative outputs from rate of change calculation circuitry 300 are also provided to well controller 144. The communication over connection 152 can be in accordance with any appropriate technique. Examples include HART®, Fieldbus, Modbus, Profibus, as well as other communication techniques. Additionally, wireless communication techniques may be included such as WirelessHART®. In this configuration, well controller 144 can implement a plunger event detection algorithm based upon the first and/or second derivatives as well as based upon timing information related to when the plunger begins its descent into the well 100. For example, the well controller 144 can observe events in the first and/or second derivatives after a certain period has passed, for example ten minute, after a well shut in event has occurred. If the first and/or second derivative exceeds a preconfigured limit after this time period has elapsed, this can be used as an indication to the well controller 144 that the plunger has reached the bottom of the well and the well controller 144 can command the motor valve to open.

Figure 13:
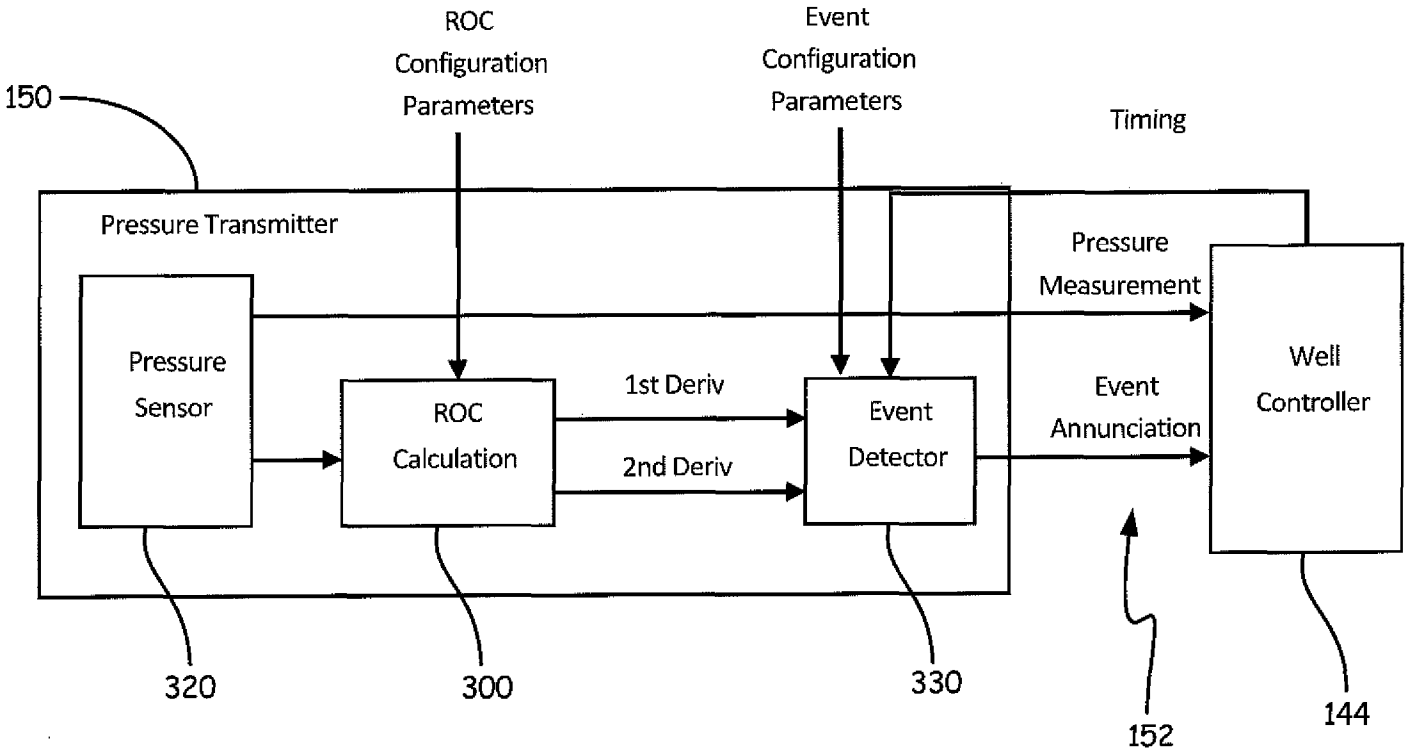
FIG. 13 is another example embodiment of a pressure transmitter and well controller.

FIG. 13 illustrates another example embodiment in which the pressure transmitter itself includes an event detector 330 which identifies a plunger event based upon the first and/or second derivative as well as additional information. For example, timing information can be provided by well controller 144 to event detector 330 which is related to when the plunger begins its descent into the well. Event configuration parameters can be provided to the event detector 330. These can include, for example, threshold levels related to the first and/or second derivatives, as well as the timing delay to be implemented before the event detection algorithm is applied to the first and/or second derivatives. The timing information can be communicated from well controller 144 to the event detector 330 using connection 152. Again, this communication can be in accordance with standard process controller monitoring communication protocols. Of course, propriety techniques may also be used. Upon detection of the plunger reaching the bottom of the well, the transmitter 150 communicate status information, for example, a status bit, to the well controller 144 over connection 152. The well controller 144 can then operate in accordance with logic stored therein to begin raising the plunger.

Figure 14:
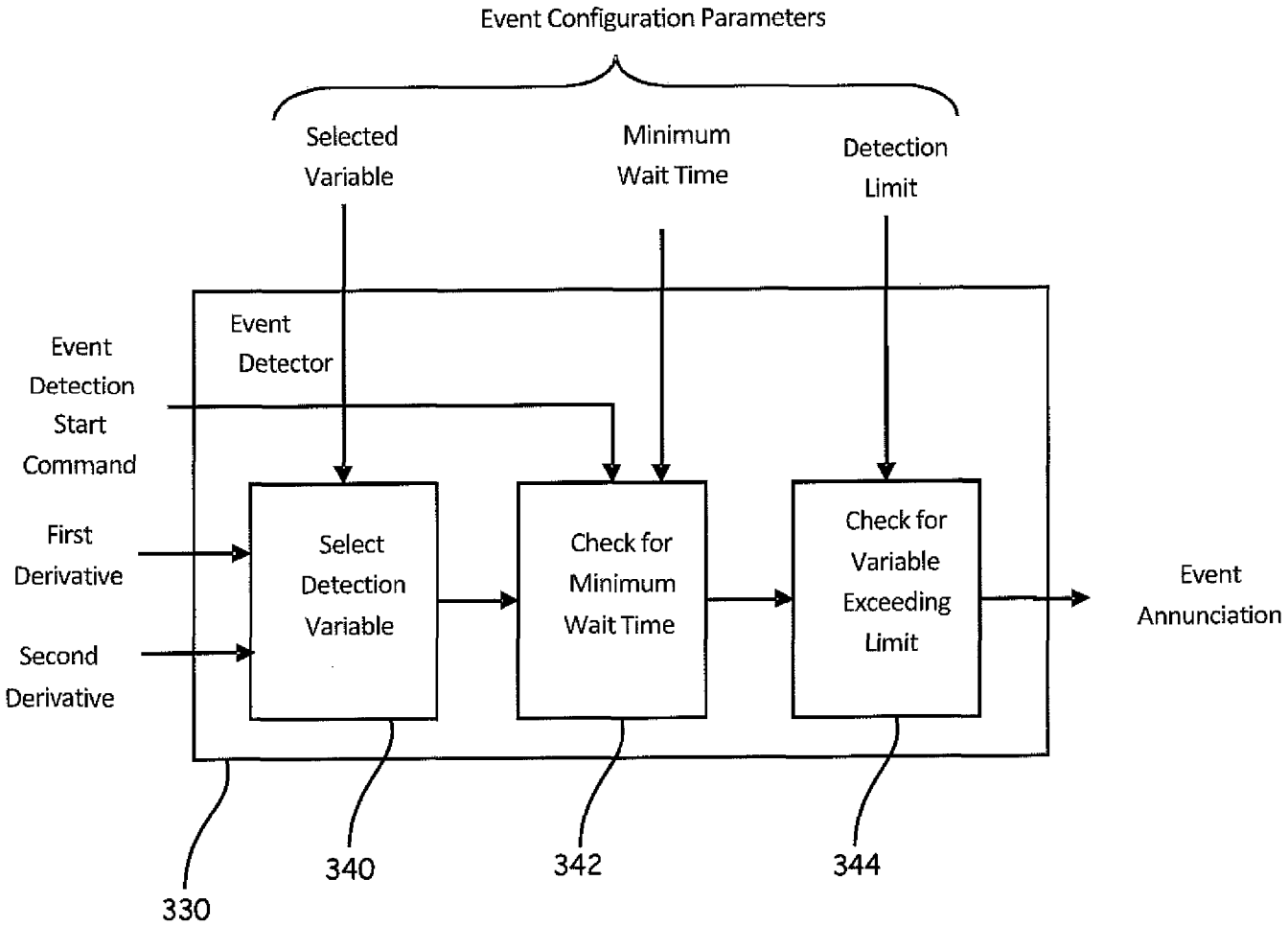
FIG. 14 is a simplified block diagram of an event detector illustrated in FIG. 13.

FIG. 14 is a simplified block diagram showing a more detailed view of event detection circuitry 330. At block 340, one or both of the first and second derivatives can be selected for use in identifying when the plunger has reached the bottom of the well. Based upon this selection, an output is provided to block 342 in which the wait time prior to initiation the detection algorithm is determined. For example, this may be the time during which any derivative events which are not related to the plunger reaching the bottom of the well have passed. If the appropriate time period has passed, at block 344 it is the particular first and/or second derivative is compared to a threshold. If the threshold has been exceeded an event annunciation output is provided. Note that other comparison techniques may be used, for example, a particular signature or waveform in the first and/or second derivative can be observed, the relative values of the first and second derivatives can be monitored, the duration during which the first and/or second derivative has exceeded a threshold can be observed, etc. Upon identification of an event using the first and/or second derivative, an event annunciation output is provided. In another example, the event annunciation is based upon a comparison of the first derivative with a first threshold and the second derivative with a second threshold. The output can be provided to the well controller for use in controlling operation of the well.

Although the present invention has been described with reference to preferred embodiments, workers skilled in the art will recognize that changes may be made in form and detail without departing from the spirit and scope of the invention. Although first and second derivatives are discussed above, any order derivative may be used. The various components or circuits discussed herein can be implemented in software, hardware, or their combination. Both analog and/or digital circuitry may be used.

What is claimed is:

1. A system for detecting when a plunger reaches a bottom of a well, comprising:

a pressure sensor configured to measure a pressure of the well and provide a measured pressure output;

derivative calculation circuitry configured to calculate a derivative of the measured pressure output;

detection circuitry which detects when the plunger reaches the bottom of the well based upon the derivative output; and wherein the derivative comprises a second derivative.

2. The system of claim 1, wherein the derivative is related to a curvature indication.

3. The system of claim 1, wherein the derivative calculation circuitry calculates the derivative over a sampling window.

4. The system of claim 3, wherein the sampling window is configurable.

5. The system of claim 1, wherein the detection circuitry detects when the plunger reaches the bottom of the well based upon first and second derivatives of the measured pressure output.

6. The system of claim 1, wherein the pressure sensor, derivative calculation circuitry and detection circuitry are implemented in a pressure transmitter.

7. The system of claim 1, including a pressure transmitter which implements the derivative calculation circuitry.

8. The system of claim 1, including a well controller which implements the detection circuitry.

9. The system of claim 1, wherein the detection circuitry further receives a timing input related to when the plunger begins descending into the well, and wherein the detection circuitry detects when the plunger reaches the bottom of the well based upon the derivative and the timing input.

10. The system of claim 9, wherein the timing input is provided by a well controller.

11. The system of claim 1, including damping circuitry configured to dampen the measured pressure output.

12. The system of claim 1, including down sample circuitry configured to down sample the measured pressure output.

13. The system of claim 1, wherein the detection circuitry operates in accordance with a minimum wait time parameter.

14. The system of claim 13, wherein the minimum wait time parameter is configurable.

15. The system of claim 1, wherein the detection circuitry operates in accordance with a detection threshold limit.

16. The system of claim 14, wherein the detection threshold limit is configurable.

17. A method of detecting when a plunger has reached a bottom of a well, comprising:

measuring a pressure of the well and providing a measured pressure output;

calculating a derivative of the measured pressure output;

detecting when the plunger reaches the bottom of the well based upon the calculated derivative; and wherein the derivative comprises a second derivative.

18. The method of claim 17, wherein the derivative is related to a curvature indication.

19. The method of claim 17, wherein the derivative is calculated over a sampling window.

20. The method of claim 19, wherein the sampling window is configurable.

21. The method of claim 17, wherein the detection is based upon a first and a second derivative.

22. The method of claim 17, wherein the detection is further based upon timing information related to when the plunger begins descending into the well.

23. The method of claim 22, wherein the timing information is provided by a well controller.

24. The method of claim 17, including damping the measured pressure output.

25. The method of claim 17, including down sampling the measured pressure output.

26. The method of claim 17, wherein the detecting is in accordance with a minimum wait time parameter.

27. The method of claim 26, wherein the minimum wait time parameter is configurable.

28. The method of claim 17, wherein the detecting is in accordance with a detection threshold limit.

29. The method of claim 17, wherein the detection threshold limit is configurable.

* * * * *